US011878833B2

(12) United States Patent
Kellerer et al.

(10) Patent No.: US 11,878,833 B2
(45) Date of Patent: Jan. 23, 2024

(54) FOLDING CONTAINER

(71) Applicant: Schoeller Allibert GmbH, Schwerin (DE)

(72) Inventors: Richard Kellerer, Feldkirchen (DE); John Huizingh, Vlagtwedde (NL)

(73) Assignee: Schoeller Allibert GmbH, Schwerin (DE)

( * ) Notice: Subject to any disclaimer, the term of this patent is extended or adjusted under 35 U.S.C. 154(b) by 135 days.

(21) Appl. No.: 17/604,428

(22) PCT Filed: Mar. 4, 2020

(86) PCT No.: PCT/EP2020/055698
§ 371 (c)(1),
(2) Date: Oct. 17, 2021

(87) PCT Pub. No.: WO2020/212012
PCT Pub. Date: Oct. 22, 2020

(65) Prior Publication Data

US 2022/0177189 A1 Jun. 9, 2022

(30) Foreign Application Priority Data

Apr. 18, 2019 (EP) ..... 19170271

(51) Int. Cl.
*B65D 6/18* (2006.01)
*B65D 21/02* (2006.01)
(Continued)

(52) U.S. Cl.
CPC ..... *B65D 11/1833* (2013.01); *B65D 21/0217* (2013.01); *B65D 25/30* (2013.01);
(Continued)

(58) Field of Classification Search
CPC .. B65D 11/1833; B65D 43/22; B65D 43/163; B65D 25/30; B65D 51/242
(Continued)

(56) References Cited

U.S. PATENT DOCUMENTS 621,044 A * 3/1899 Deerwester
964,121 A * 7/1910 Rose
(Continued)

FOREIGN PATENT DOCUMENTS

CN 101590925 A 12/2009
CN 108860917 A 11/2018
(Continued)

OTHER PUBLICATIONS

Search Report received in International Application No. PCT/EP2020/055698 dated Apr. 15, 2020, with translation, 5 pages.
(Continued)

*Primary Examiner* — Stephen J Castellano
(74) *Attorney, Agent, or Firm* — Christopher A. Rothe; Culhane Meadows PLLC

(57) ABSTRACT

A foldable container includes a bottom, side walls that can be folded in, a lid, a closure element that can be moved relative to the lid, at least one first closure element mating piece, and at least one second closure element mating piece. The at least one second closure element mating piece is provided on a portion of the side walls that faces the bottom and/or on the bottom in such a way that, in a storage position of the lid, the at least one second closure element mating piece can interact in a form-fitting manner with the closure element in order to lock the lid in the storage position with the side walls folded in.

12 Claims, 9 Drawing Sheets

(51) Int. Cl.

| | |
|---|---|
| ***B65D 25/30*** | (2006.01) |
| ***B65D 43/16*** | (2006.01) |
| ***B65D 43/22*** | (2006.01) |
| ***B65D 51/24*** | (2006.01) |

(52) U.S. Cl.
CPC ..... *B65D 43/163* (2013.01); *B65D 43/22* (2013.01); *B65D 51/242* (2013.01)

(58) Field of Classification Search
USPC ..... 220/7, 833, 756
See application file for complete search history.

(56) References Cited

U.S. PATENT DOCUMENTS

| | | | | |
|---|---|---|---|---|
| 1,131,638 | A * | 3/1915 | Larson | B65D 11/1833 220/7 |
| 5,367,718 | A * | 11/1994 | Ellis | B65D 43/22 4/479 |
| 2014/0048369 | A1 | 2/2014 | Zhu | |

FOREIGN PATENT DOCUMENTS

| | | | |
|---|---|---|---|
| DE | 202011002617 | U1 | 6/2011 |
| EP | 2223860 | A1 | 9/2010 |

OTHER PUBLICATIONS

Office Action received in Chinese Application No. 202080038391 X dated Jan. 13, 2023, with translation, 7 pages.
Search Report received in Chinese Application No. 202080038391 X dated Dec. 15, 2022, with translation, 4 pages.
Written Opinion received in International Application No. PCT/EP2020/055698 dated Apr. 15, 2020, with translation, 10 pages.

* cited by examiner

FOLDING CONTAINER

CROSS-REFERENCE TO RELATED APPLICATIONS

This application is the United States national phase entry of International Application No. PCT/EP2020/055698, filed Mar. 4, 2020, and claims the benefit of priority of European Application No. 19 170 271.1, filed Apr. 18, 2019. The contents of International Application No. PCT/EP2020/055698 and European Application No. 19 170 271.1 are incorporated by reference herein in their entireties.

FIELD

The present invention relates to a foldable container, and in particular it relates to a foldable container having a bottom, side walls, in particular four side walls, that can be folded in, a lid and a closure element by means of which the lid can be coupled with the bottom and/or at least one of the side walls in a form-fitting manner when the lid is placed on the side walls.

BACKGROUND

A container of the generic kind is for instance known from DE 20 2011 002 617 U1. The container as disclosed in DE 20 2011 002 617 U1 comprises a bottom, two first side walls which can be folded inwards, and two second side walls which can be folded outwards by approximately 270 degrees. In a position of use, the four side walls are erected and extend perpendicularly to the bottom. In a folded-in position, the four side walls extend in parallel to the bottom, wherein the first side walls extend below the bottom and the second side walls extend above the bottom. In order to close the container, the lid can be placed on the four erected side walls. At the second side walls there are provided snap-in recesses which are able to interact with snap-in tongues provided correspondingly at the lid when the lid is placed on the erected side walls. The lid and the bottom of the container according to DE 20 2011 002 617 U1 are provided with stacking edges in such a way that a lateral displacement of the lid is prevented even if the lid will be placed on the folded-in side walls.

The problem of the container according to DE 20 2011 002 617 U1 is that the lid is not secured against a lifting thereof when the lid has been placed on the folded-in side walls.

SUMMARY

Hence, the object of the present invention is to provide a foldable container the components of which will be held together even in a folded-up state.

A foldable container according to the invention has a bottom, side walls, a lid, a closure element, at least one first closure element mating piece and at least one second closure element mating piece.

The bottom has in particular a rectangular layout so that the foldable container comprises in particular four side walls.

The side walls are hinged in a pivotally movable manner at an edge of the bottom. In an erected position, a respective side wall extends upwards transversely to the bottom. In a folded-in position, a respective side wall extends at least substantially in parallel to the bottom. "Substantially in parallel" means that a position in which there is a slight inclination of one of the side walls, for instance due to the fact that several side walls lie on top of each other, can also be regarded as a folded-in position.

In particular, the side walls are hinged at the bottom in such a way that from the erected position they can only be folded inwards into the folded-in position.

The lid is configured to be placed on the side walls in their erected position in order to close the foldable container. Said position of the lid relative to the side walls and to the bottom will be called closed position in the following. Furthermore, the lid is configured to be placed on the side walls in their folded-in position so that it can be stored or stowed away in a space-saving manner in case of an empty transport. Said position of the lid relative to the side walls and to the bottom will be called storage position in the following. In particular, the lid has stacking contours which can interact with the side walls and/or the bottom in order to prevent or at least to impede a lateral displacement of the lid relative to the side walls and the bottom when the lid has been placed on the side walls.

The closure element is provided at least partially in a portion of an edge of the lid in order to lock the lid when the lid has been placed on the erected side walls or when the lid is in the closed position. The closure element can be moved relative to the lid. In particular, the closure element is designed in the form of a locking latch separately from the lid and is coupled with the lid in a movable manner.

Here, by "to lock" or "locking" there is meant to fix/to secure the lid or a fixing or securing of the lid.

The at least one first closure element mating piece is provided on an edge of the side walls that faces away from the bottom, in particular on an upper edge of the side walls, in such a way on the side walls that, in the closed position of the lid, the at least one first closure element mating piece can interact in a form-fitting manner with the closure element.

The at least one second closure element mating piece is provided on an edge or portion of the side walls that faces the bottom, in particular on a lower edge or portion of the side walls, and/or on the bottom in such a way that, in the storage position of the lid, the at least one second closure element mating piece can interact in a form-fitting manner with the closure element in order to lock the lid in the storage position, in particular such that the side walls are held in their folded-in position.

With respect to the first closure element mating piece and also with respect to the second closure element mating piece, "interact in a form-fitting manner" means that a section of the closure element engages behind a section of the corresponding closure element mating piece in such a way that the closure element is coupled directly with the closure element mating piece in a form-fitting manner. In other words, the at least one first closure element mating piece and the at least one second closure element are configured and arranged such that, in the closed position or the storing position of the lid, the closure element can hook into the corresponding closure element mating piece.

In other words, the container according to the invention is characterized in that the closure element enables a form-fitting coupling of the lid to the side walls or on the bottom in the closed position of the lid as well as also in the storage position of the lid.

At the edge of the lid there can be provided at least one groove into which at least one portion of said edge of the side walls that faces away from the bottom projects in the closed position of the lid. Hence, a folding-in of at least one of the side walls can be prevented in a form-fitting manner by means of the at least one groove. In particular, the at least one groove can be implemented by means of two ribs which demarcate the corresponding groove.

The side walls of the container according to the invention can be implemented such that two mutually opposed first side walls have to be in the folded-in position so that two mutually opposed second side walls can be folded in. In other words, the first side walls can be configured such that, in their erected position, they block the second side walls so that said second side walls cannot be folded in. By the folding-in of the first side walls the blocking of the second side walls is eliminated. For the two first side walls there can be provided a groove, respectively, on the edge of the lid, into which groove at least one portion of said—in particular upper—edge of the corresponding first side wall that faces away from the bottom projects in the closed position of the lid. In particular, the lid can be configured such that, only on portions of the edge of the lid that are predetermined to come into contact with the first side walls in the closed position of the lid, there are provided grooves for accommodating a portion of said—in particular upper—edge of the corresponding side walls that faces away from the bottom.

The lid according to the invention can be implemented such that said portion of the edge of the lid that is provided with the closure element rests on one of the second side walls in the closed position and in the storage position of the lid.

At said portion of the edge of the lid that is provided with the closure element there can be provided a groove into which at least one portion of said edge of the corresponding second side wall that faces away from the bottom projects in the closed position of the lid. At the container according to the invention, in a portion of the edge of the lid that lies opposite to said portion of the edge of the lid that is provided with the closure element, there can be provided at least one hook element. On the edge of the side walls that faces away from the bottom there can be provided at least one first hook element mating piece which is provided on the side walls in such a way that, in the closed position of the lid, the at least one first hook element mating piece can interact in a form-fitting manner with the hook element. On said edge or portion of the side walls that faces away from the bottom and/or on the bottom there can be provided at least one second hook element mating piece in such a way that, in the storage position of the lid, the at least one second hook element mating piece can interact in a form-fitting manner with the hook element in order to lock the lid in the storage position, in particular such that the side walls are held in their folded-in position.

With respect to the first hook element mating piece and also with respect to the second hook element mating piece, "interact in a form-fitting manner" means that a section of the hook element engages behind a section of the corresponding hook element mating piece in such a way that the hook element is coupled directly with the hook element mating piece in a form-fitting manner. In other words, the at least one first hook element mating piece and the at least one second hook element mating piece are configured and arranged such that, when the lid is placed on the side walls in their erected position and/or when the lid is placed on the side walls in their folded-in position, the hook element can hook into the corresponding hook element mating piece. An unhooking of the hook element from the first hook element mating piece or from the second hook element mating piece can be prevented in particular by implementing the closure element and/or the grooves provided at the lid in such a way that a lateral displacement of the lid relative to the side walls or the bottom will be prevented in a form-fitting manner in the closed position and in the storage position of the lid.

The at least one first closure element mating piece can be implemented as a recess in an inner surface of the second side walls. The at least one first hook element mating piece can be implemented as a recess in an outer surface of the second side walls. On portions of the edge of the bottom at which one of the second side walls is hinged in a pivotally movable manner, respectively, there can be provided an edge web, respectively. The at least one second closure element mating piece can be implemented as a recess in an inner surface of one of the edge webs. The at least one second hook element mating piece can be implemented as a recess in an outer surface of one of the edge webs. In this connection, "recess" can be understood as an indentation or a cavity as well as also as a through-passage or an opening.

Each of the second side walls can comprise at least one first closure element mating piece and at least one first hook element mating piece. Each edge web can comprise at least one second closure element mating piece and at least one second hook element mating piece. Thereby it can be rendered possible to place the lid on the side walls as well as to couple the lid with said side walls in two different orientations.

The at least one first closure element mating piece and the at least one first hook element mating piece of a respective second side wall can be implemented together by means of a joint passage opening or a joint through-passage. The at least one second closure element mating piece and the at least one second hook element mating piece of a respective edge web can be formed together by means of a joint passage opening or a joint through-passage.

The closure element can be coupled with the lid in such a way that the closure element can be moved relative to the lid in a slidable or translational manner from a locking position into an open position. In this connection, the locking position can be a position of the closure element in which the closure element is in engagement with the at least one first closure element mating piece in the closed position of the lid, and/or in which the closure element is in engagement with the at least one second closure element mating piece in the storage position of the lid. The open position can be a position of the closure element in which the closure element is not in engagement with the at least one first closure element mating piece in the closed position of the lid, and/or in which the closure element is not in engagement with the at least one second closure element mating piece in the storage position of the lid.

Alternatively or additionally, the closure element can be coupled with the lid in such a way that it can be pivotally moved relative to the lid from a locking position into an open position.

The at least one closure element can be formed as a U-shaped bracket. In particular, the closure element can be formed as a U-shaped bracket insofar as it comprises two free ends which, in the closed position of the lid and the simultaneous locking position of the closure element, are respectively in engagement with a corresponding first closure element mating piece, and, in the storage position of the lid and the simultaneous locking position of the closure element, are respectively in engagement with a corresponding second closure element mating piece. In other words, the container can be implemented such that two first closure element mating pieces and two second closure element mating pieces are assigned to the at least one closure element.

The at least one closure element can be pretensioned into the locking position by means of a spring element. The spring element can be formed integrally, i.e. in one piece with the closure element or separately from the closure element. In particular, the closure element can have an oblique surface relative to a displacement direction of the closure element. Said oblique surface can be particularly arranged in such a way that the oblique surface will come into contact with the side walls when the lid is placed on the side walls, that said contact of the oblique surface with the side walls will effect a displacement of the closure element from the locking position into the open position, that, when the open position is reached, the lid can be placed on the side walls with low resistance, and that, in a last phase of the placing of the lid on the side walls, the spring element will effect a displacement of the closure element from the open position into the locking position and, thus, an engaging of the closure element into the first closure element mating piece or the second closure element mating piece.

A handle can be connected to the lid in such a way that the handle can be moved relative to the lid from a holding position into a retraction position. With respect to the retraction position, the holding position can be characterized particularly by the fact that, in the holding position, the handle protrudes farther away from the lid than in the retraction position. The holding position is specifically intended or adapted for enabling a user to grip the lid in a simple manner. The retraction position is specifically intended or adapted for stowing away the handle in such a way that it will not interfere with the stacking of a container onto the container according to the invention. The handle can be arranged in such a way at the at least one closure element that the handle, in its holding position, fixes or secures the at least one closure element in its locking position. In particular, the handle can be configured such that, in its holding position, it contacts the closure element and that said contact prevents the closure element from being brought from its locking position into its open position.

The handle and the closure element can be implemented such that a shifting of the handle from the retraction position into the holding position will effect a shifting of the closure element from the open position into the locking position. In other words, the handle and the closure element can each have a contact surface, wherein said contact surfaces are implemented such that, in the open position of the closure element, they will contact each other at least during the shifting of the handle from the retraction position into the holding position, and that the contact surface of the handle will influence the contact surface of the closure element by the contacting in such a way that the closure element will be brought from its open position into the locking position.

The handle and the closure element can be implemented such that a shifting of the handle from the holding position into the retraction position will effect a shifting of the closure element from the locking position into the open position. In other words, the handle and the closure element can each comprise a contact surface, wherein said contact surfaces are implemented such that, in the locking position of the closure element, they will contact each other at least during shifting of the handle from the holding position into the retraction position, and that the contact surface of the handle will influence the contact surface of the closure element by the contacting in such a way that the closure element will be brought from its locking position into the open position. Alternatively or additionally, the at least one closure element can be pretensioned by means of a spring element into the open position. The spring element can be formed integrally with the closure element or separately from the closure element.

BRIEF DESCRIPTION OF THE DRAWING FIGURES

The present invention will be described in more detail in the following by means of preferred embodiments with reference to the attached drawings, wherein.

Identical or functionally equivalent features are provided with the same reference numerals in the individual figures.

DETAILED DESCRIPTION

Figure 1:
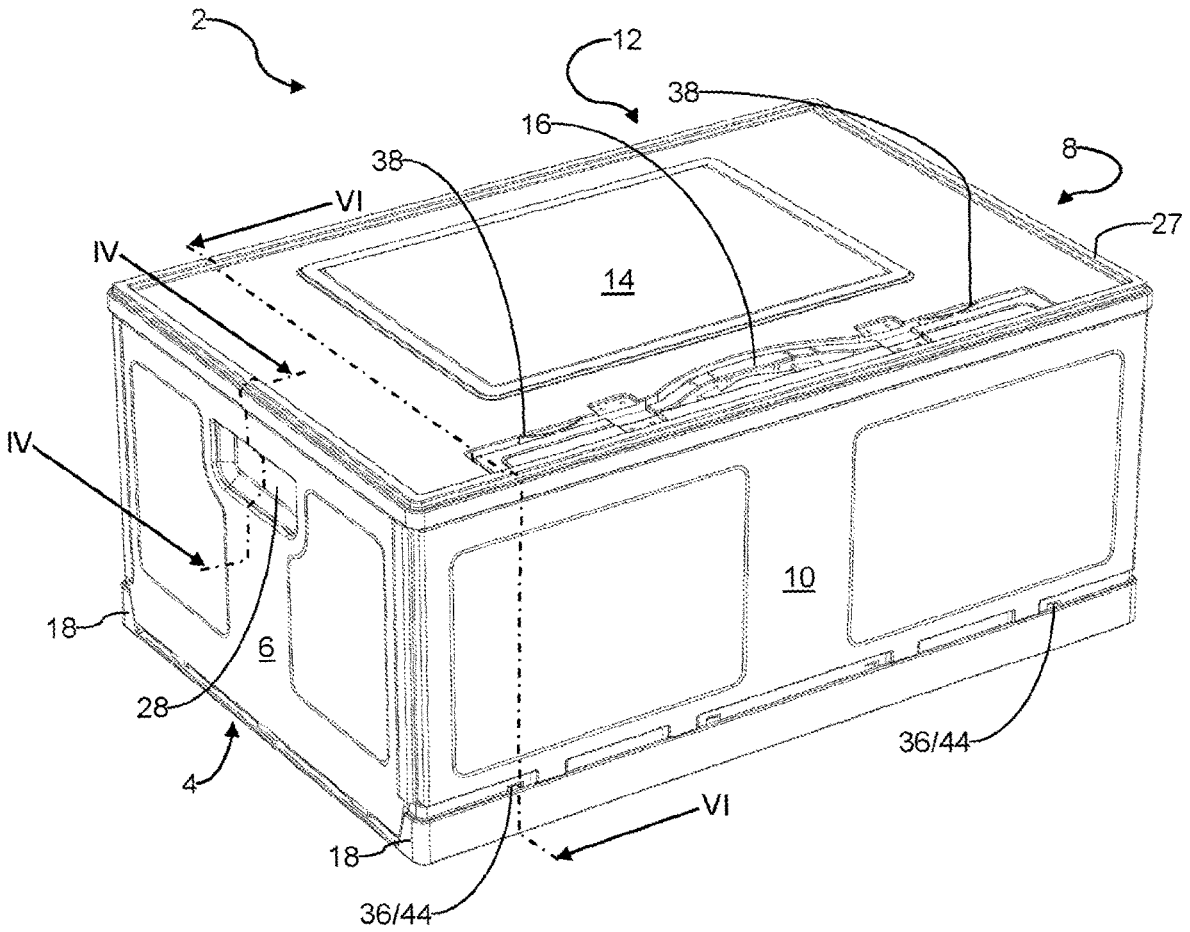
FIG. 1 is a perspective view of a container according to a first embodiment of the invention with side walls in an erected position.

FIG. 1 shows a container 2 having a bottom 4, two first side walls 6 and 8, two second side walls 10 and 12, a lid 14 as well as a closure element 16. In the state as shown in FIG. 1, the first side walls 6 and 8 as well as the second side walls 10 and 12 are in an erected position in which they extend perpendicularly to the bottom 4.

The bottom 4, the first side walls 6 and 8, the second side walls 10 and 12 as well as the lid 14 each have a substantially rectangular contour so that the container 2 as a whole has a substantially cuboidal contour. The first side walls 6 and 8 are hinged at short lateral edges of the bottom 4. The second side walls 10 and 12 are hinged at long lateral edges of the bottom 4. At the lateral edges of the bottom 4 at which the second side walls 10 and 12 are hinged, the bottom 4 has an edge web 18, respectively, so that the bottom 4 substantially has the form of a U-profile.

The first side walls 6 and 8 as well as the second side walls 10 and 12 are connected with the bottom 4 via hinges. In this respect, for the connection of the second side walls 10 and 12 the hinges are arranged at upper edges of the edge webs 18 in such a way that they are spaced apart farther away from an underside of the bottom 4 than the hinges for the connection of the first side walls 6 and 8. When the first side walls 6 and 8 are pivoted into a folded-in position, they substantially extend in parallel to the bottom 4. The edge webs 18 and the higher arrangement of the hinges of the second side walls 10 and 22 compared against the arrangement of the hinges of the first side walls 6 and 8 ensure that the first side walls 6 and 8, in their folded-in position, will not block a folding-in of the second side walls 10 and 12 from the erected position into a corresponding folded-in position, and that the second side walls 10 and 12, in their folded-in position, can extend above the first side walls 6 and 8 substantially in parallel to the bottom 4.

The first side walls 6 and 8 extend between the second side walls 10 and 12 in such a way that the second side walls 10 and 12 cannot be folded in when the first side walls 6 and 8 are not in a folded-in state.

The hinges of the second side walls 10 and 12 are implemented such that the second side walls 10 and 12 can only be folded inwards. In order to prevent a folding of the first side walls 6 and 8 outwards, the second side walls 10 and 12 have angles or elbows 20 at their lateral edges, respectively, which fence or enclose the first side walls 6 and 8. Thus, the second side walls substantially have the form of a U-profile (see FIG. 2).

The lid 14 can be placed on the upper edges of the side walls 6, 8, 10 and 12 when the latter are in their erected position. As thereby the lid 14 closes the container 2, the position of the lid in which the lid has been placed on the erected side walls 6, 8, 10 and 12 will be called closed position in the following.

Figure 3:
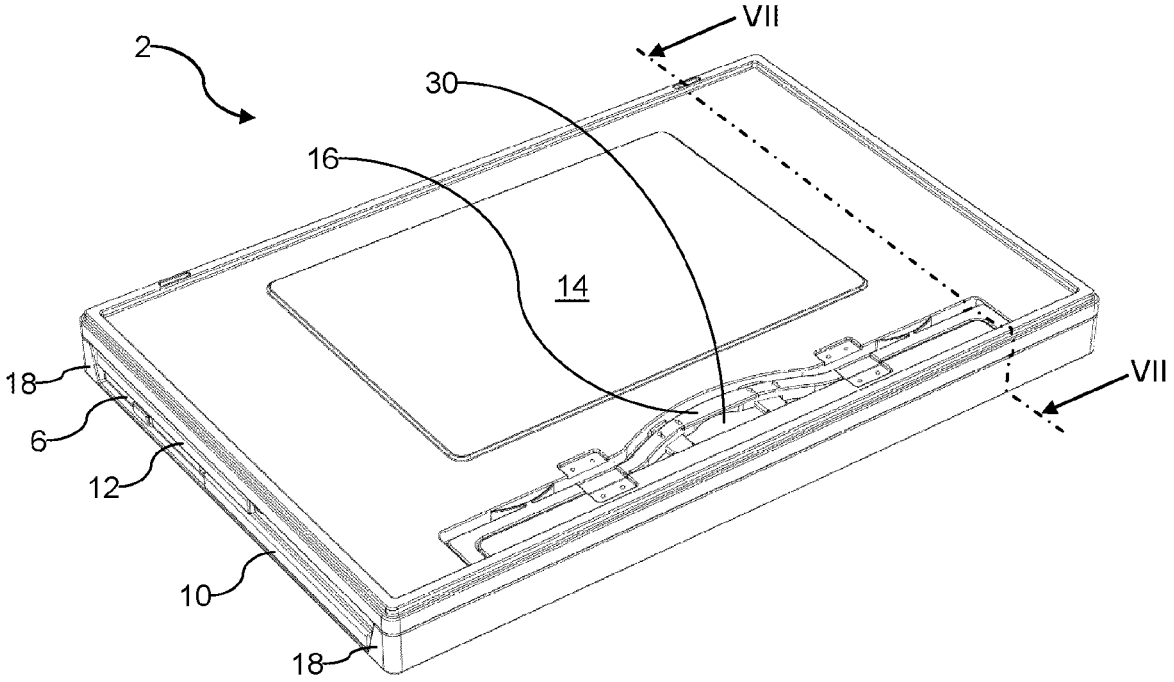
FIG. 3 is a perspective view of the container as shown in FIG. 1 with the side walls in a folded-in position.

As is shown in FIG. 3, the lid 14 can also be placed on the side walls 6, 8, 10 and 12 when the latter are in their folded-in position. As in this connection the lid 14 is particularly suited for a space-saving storage or stowing-away, the position of the lid in which it has been placed on the folded-in side walls 6, 8, 10 and 12 will be called storage position in the following.

The lid 14 is designed such that a folding-in of the first side walls 6 and 8 is prevented when the lid 14 is in its closed position. This is illustrated in FIG. 4 which is a partial sectional view along line IV-IV as shown in FIG. 1.

Figure 4:
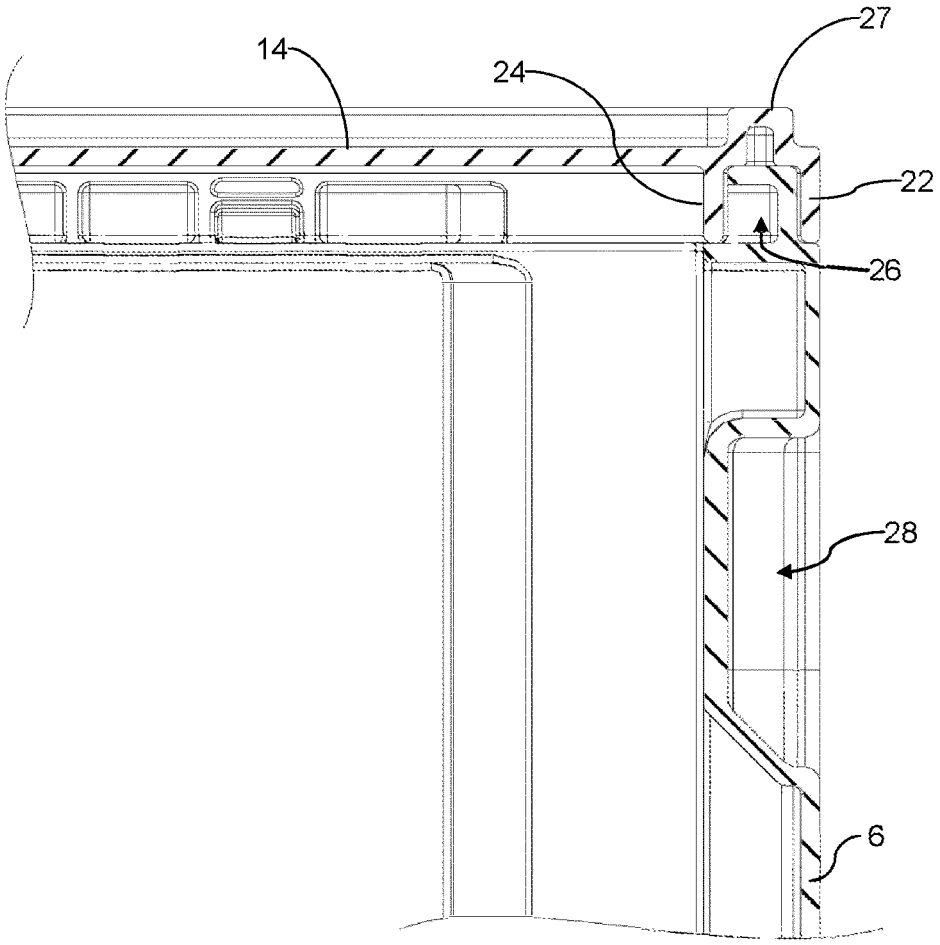
FIG. 4 is a sectional view of a first side wall of the container as shown in FIG. 1.

In FIG. 4 there is shown that the lid 14, at its underside at its edge, has an edge web 22 that extends downwards when the lid 14 is in the closed position. The edge web 22 extends along the entire periphery of the lid. In parallel to the edge web 22 there extends a rib 24 which is offset towards the inside. The rib 24 extends along the rims of the lid which are intended for being placed on the first side walls 6 and 8. Moreover, the rib 24 also extends along one of the two rims which are intended for being placed on the second side walls 10 and 12. In other words, the rib 24 extends along three of four rims of the lid 14.

Between the edge web 22 and the rib 24 there is formed a groove 26. The groove 26 is formed such that it can accommodate therein upper edges of the first side walls 6 and 8 when the lid 14 is in the closed position. Hence, in the closed position of the lid 14, the groove 26 or the rib 24 interacts in a form-fitting manner with the first side walls 6 and 8 and prevents the folding inwards of the first side walls 6 and 8.

At its underside at its edge, the lid 14 has a circumferential protrusion 27 which extends upwards when the lid 14 is in the closed position. At its underside, the bottom 4 has a groove (not shown) corresponding to the protrusion 27, which groove can accommodate the protrusion 27 of an identically constructed container or of a similar container having an identically constructed lid and an identically constructed bottom, when the container 2 is stacked upon the identically constructed container or the similar container having an identically constructed lid and an identically constructed bottom. In this connection it is irrelevant whether the side walls 6, 8, 10 and 12 are in the erected position or in the folded-in position.

Figure 5A:
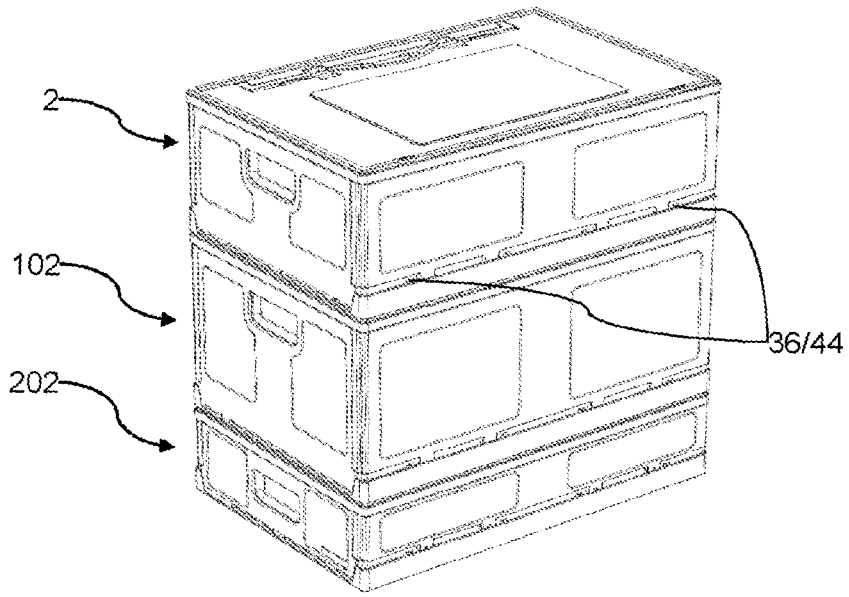
FIG. 5A and FIG. 5B are perspective views of the container as shown in FIG. 1 in stacked states.

FIG. 5A shows the container 2 in a state in which the side walls 6, 8, 10 and 12 are in the erected position and in which the container 2 is stacked upon containers 102 and 202 having identically constructed lids, identically constructed bottoms and respectively erected side walls.

Figure 5B:
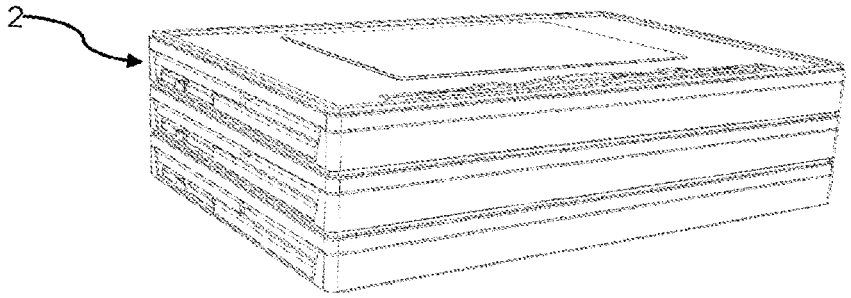

FIG. 5B shows the container 2 in a state in which the side walls 6, 8, 10 and 12 are in the folded-in position and in which the container 2 is stacked upon identically constructed containers with respectively folded-in side walls.

In order to bring the first side walls 6 and 8 from the folded-in position into the erected position in a manner as simple as possible, and in order to be able to carry the container 2 as ergonomically as possible, the first side walls 6 and 8 each have a recessed grip 28 (see FIG. 1 and FIG. 4).

The closure element 16 is configured to lock the lid 14 in the closed position as well as also in the storage position.

Figure 6:
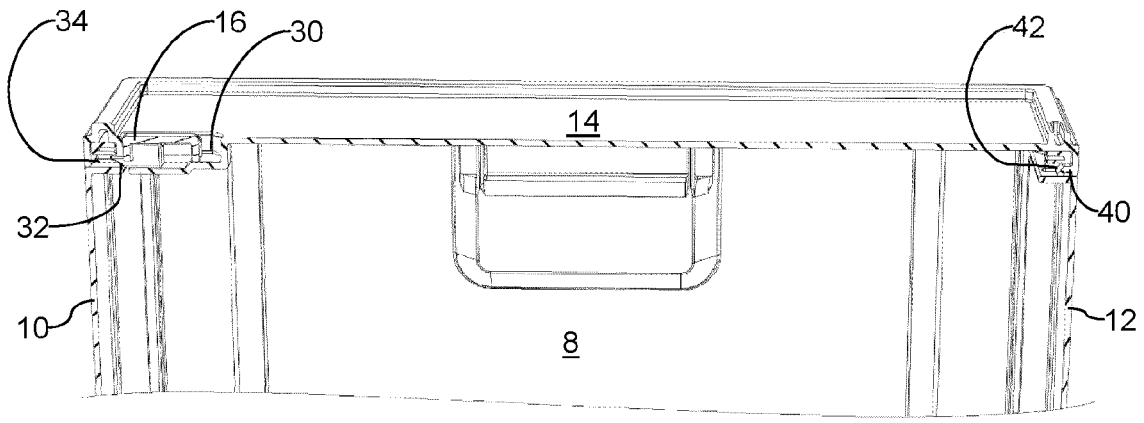
FIG. 6 is a sectional view of the container as shown in FIG. 1, wherein the lid is shown in a closed position.

FIG. 6 shows a partial sectional view along line VI-VI as shown in FIG. 1. In FIG. 6 there is shown a state of the container 2 in which the closure element 16 locks the lid 14 in the closed position.

Figure 7:
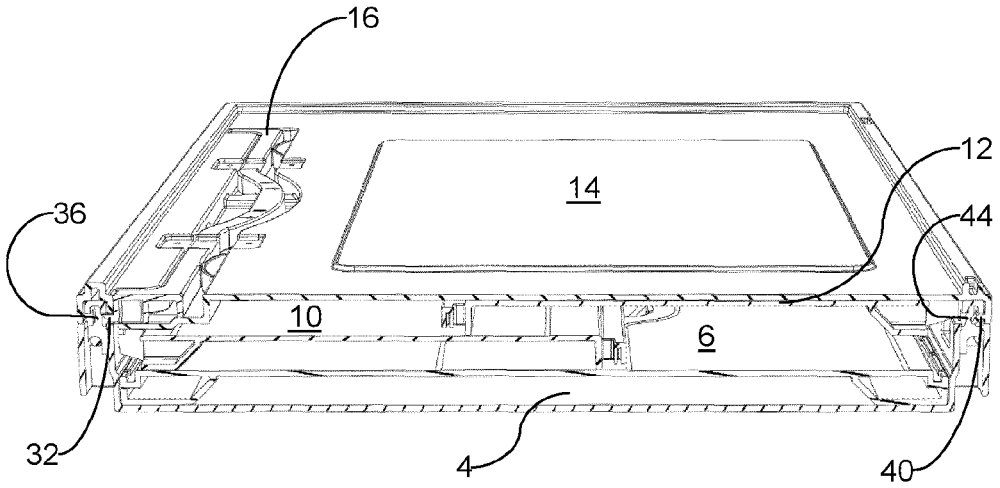
FIG. 7 is a sectional view of the container as shown in FIG. 1, wherein the lid is shown in a storage position.

FIG. 7 shows a partial sectional view along line VII-VII as shown in FIG. 3. In FIG. 7 there is shown a state of the container 2 in which the closure element 16 locks the lid 14 in the storage position.

The closure element 16 is arranged in a setback 22 of the upper side of the lid 14, said setback 22 extending up to the edge of the lid 14 or up to the rib 24. At a lateral surface directed towards the edge of the lid 14 or at a corresponding portion of the rib 24, the setback 30 comprises two openings through which, in a locking position, a section of the closure element 15, called snap-in nose 32 in the following, can project, respectively, in order to be in engagement with a corresponding first closure element mating piece 34 in the closed position of the lid 14.

Figure 2:
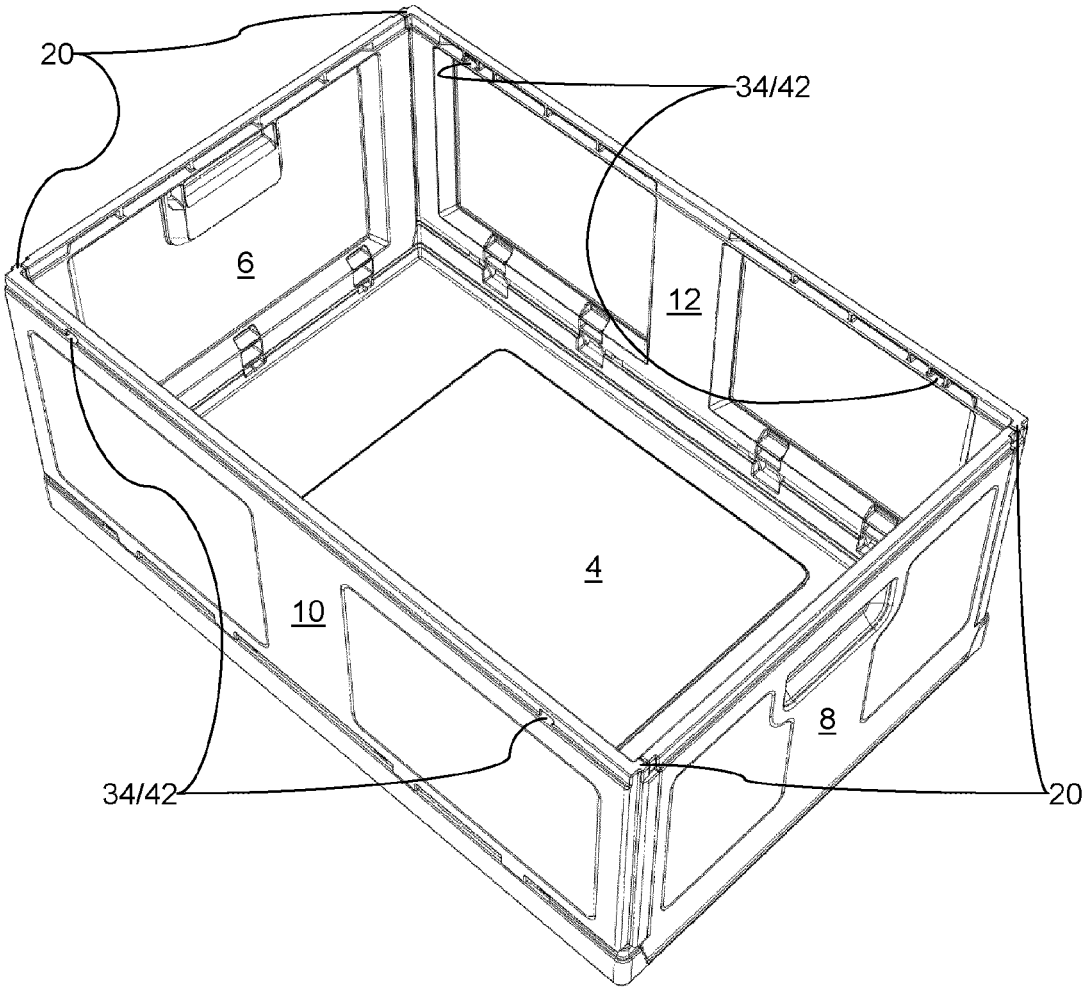
FIG. 2 is a perspective view of the container as shown in FIG. 1 without a lid.

The respective first closure element mating piece 34 is implemented as a slot at the upper edge of the second side walls 10 and 12 (see FIG. 2).

The setback 22 or the openings for the snap-in noses 32 and also the snap-in noses 32 themselves are designed such that, in the storage position of the lid 14, the snap-in noses 32 are in engagement with respective second closure element mating pieces 36.

The respective second closure element mating piece 36 is implemented as a slot at the upper edge of the edge webs 18 of the bottom 4 (see FIG. 1, FIG. 5A and FIG. 7).

The closure element 16 is designed as a U-shaped bracket insofar as the two snap-in noses 34 are realized respectively by a free end of the closure element 16. The closure element 16 is coupled to the lid 14 or the setback 30 of the lid 14 in such a way that it can be displaced from the locking position into a (not shown) open position. In the open position, the closure element 16 cannot be brought into engagement with the first closure element mating pieces 34 and also not with the second closure element mating pieces 36.

The closure element 16 comprises two elastically deformable portions, called spring portions 38 in the following. The spring portions 38 have two portions shaped like leaf springs, respectively, and are integrally formed with the closure element 16. Furthermore, the spring portions 38 are each designed such that, in the locking position and in the open position of the closure element 16, they support themselves against a lateral surface of the setback 30, respectively, which lateral surfaces lie opposite to the openings for the snap-in noses 32. Thus, the spring portions 38 pretension the closure element 16 into the locking position. The snap-in noses 32 are formed in a wedge-shaped manner in such a way that they have an oblique surface, respectively, at an underside which, when the lid 14 is placed on the erected side walls 6, 8, 10, and 12, will come into contact with the upper edges of the side walls 6, 8 10 and 12, and which, when the lid 14 is placed on the folded-in side walls 6, 8, 10 and 12, will come into contact with the upper edges of the edge webs 18 of the bottom 4, and said contact will cause a displacement of the closure element 16 into the open position. As soon as the lid is completely brought into the closed position or storage position, the spring portions 38 will effect an automatic shifting of the closure element 16 into the locking position.

At a rim of the lid 14 that lies opposite to the rim of the lid 14 that is provided with the closure element 16, at an inner side of the edge web 22 the lid 14 comprises two hook elements 40 projecting inwards. At said rim of the lid 14 that is provided with the hook elements 40, no rib 24 is provided. The hook elements 40 are configured and arranged such that, in the closed position of the lid 14, they are respectively in engagement with a corresponding first hook element mating piece 42, and that, in the storage position of the lid 14, they are respectively in engagement with a corresponding second hook element mating piece.

The slots at the upper edge of the second side walls 10 and 12 which form the first closure element mating pieces 34 simultaneously also form the first hook element mating pieces 42 (see FIG. 2).

The slots at the upper edge of the edge webs 18 of the bottom 4 which form the second closure element mating pieces 36 simultaneously also form the second hook element mating pieces 44 (see FIG. 1).

The snap-in noses 32 project from the inside into the corresponding first or second closure element mating piece, whereas the hook elements 40 each project from the outside into the corresponding first or second hook element mating piece 42 and 44. Accordingly, the lid 14 is designed such that, when the lid 14 is placed on the erected side walls 6, 8, 10 and 12, first of all the lid 14, with the rim that is provided with the hook elements 40, has to be positioned obliquely at an upper edge of one of the two second side walls 10 or 12, the hook elements 40 have to be hooked into the first hook element mating pieces 42, and then said rim that is provided with the closure element 16 has to be pivoted to the upper edge of the other one of the two second side walls 12 or 10. Moreover, the lid 14 is implemented such that, when the lid 14 is placed on the folded-in side walls 6, 8, 10 and 12, first of all the lid 4, with the rim that is provided with the hook elements 40, has to be positioned obliquely at an upper edge of one of the two second edge webs 18 of the bottom 4, the hook elements 40 have to be hooked into the second hook element mating pieces 42, and then said rim of the lid 14 that is provided with the closure element 16 has to be pivoted to the upper edge of the other one of the two edge webs 18 of the bottom 4.

Figure 8:
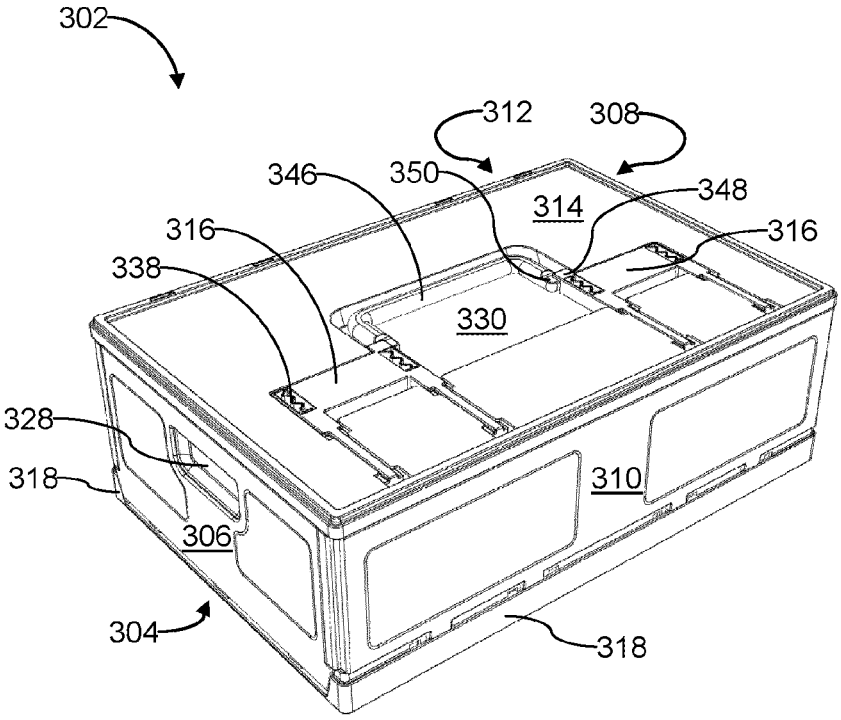
FIG. 8 is a perspective view of a container according to a second embodiment of the invention with a handle in a retraction position.
Figure 9:
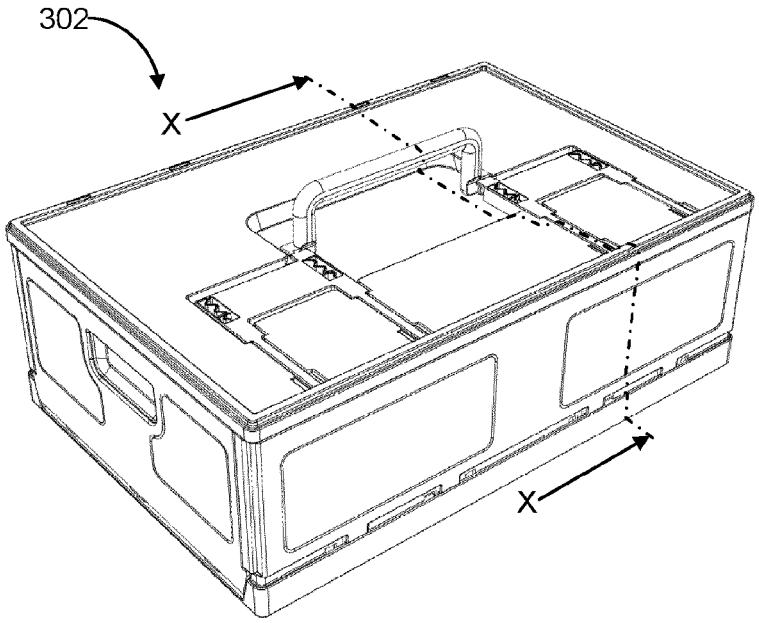
FIG. 9 is a perspective view of the container as shown in FIG. 8 with the handle in a holding position.
Figure 10:
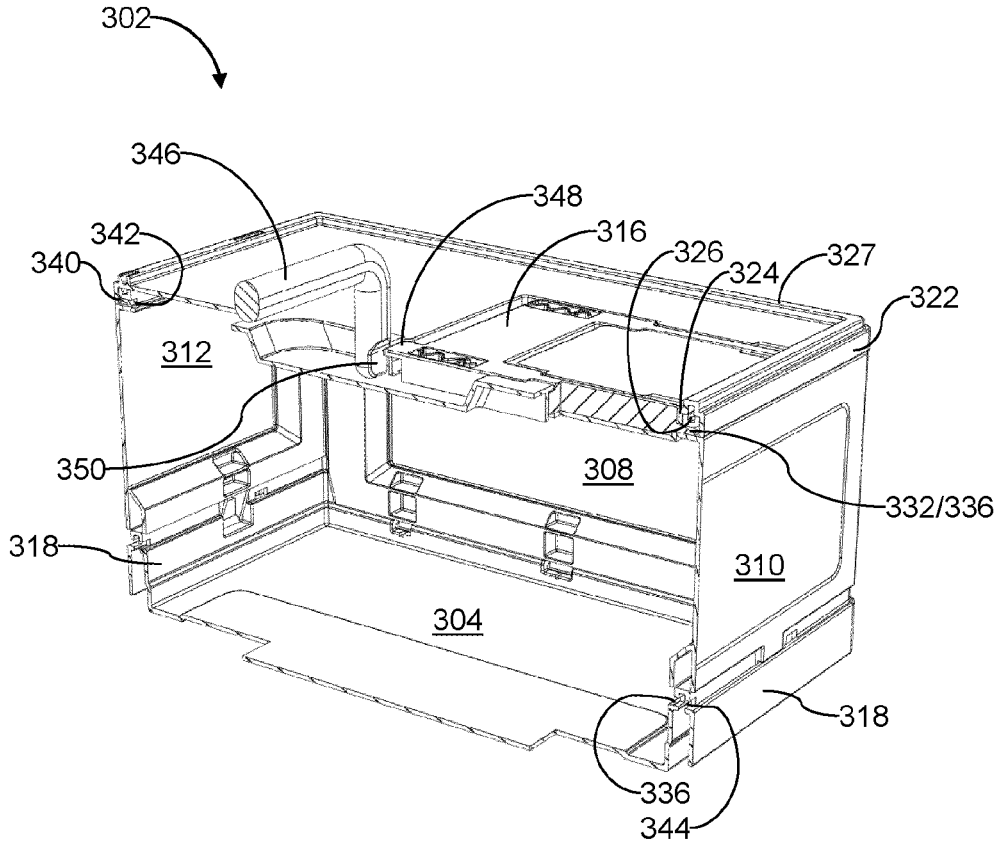
FIG. 10 is a sectional view of the container as shown in FIG. 9.

In FIG. 8, FIG. 9 and FIG. 10 there is shown a container 302 according to a second embodiment.

The container 302 according to the second embodiment differs from the container 2 according to the first embodiment with respect to the design of the closure element. The bottom 304 and the side walls 306, 308, 310 and 312 of the container 302 are designed substantially like the bottom 4 and the side walls 6, 8, 10 and 12 of the container 2 according to the first embodiment.

A lid 314 of the container 302 is provided with two closure elements 316. Said closure elements 316 are displaceably mounted in a setback 330 at an upper side of the lid 314. Furthermore, in the setback 330 there is mounted a handle 346 in a pivotally movable manner.

The handle 346 has the form of a U-shaped bracket. The free ends of the handle 346 are respectively connected to the lid 314 via an articulation or a hinge. The handle is arranged centrally at the lid 314. To each of the two free ends there is assigned a closure element 316, respectively. Each of the two closure elements 316 extends from the corresponding free end of the handle 346 to the edge of the lid 314, respectively.

The handle 346 and the setback 330 are configured in such a way that the handle 346, in a retraction position as shown in FIG. 8, is completely accommodated in the setback 330, and, in a holding position as shown in FIG. 9, projects from the setback 330 in such a way that the handle 346 can be gripped in a simple manner.

At a side pointing to the corresponding free end of the handle 346, each closure element 316 has an interaction structure 348. At a side pointing to the corresponding closure element 316, each of the two free ends of the handle 346 has an interaction structure 350.

Each interaction structure 348 of the closure elements 316 is configured such that it interacts with a corresponding interaction structure 350 of the handle 346 in such a way that a pivoting of the handle 346 from the retraction position into the holding position causes a shifting of the respective closure element 316 from an open position into a locking position. More precisely, each interaction structure 350 of the handle 346 acts in the manner of a cam which, when the handle 346 is pivoted from the retraction position into the holding position, pushes away the respective closure element 316 and shifts said closure element 316 into the locking position.

Each of the two closure elements 316 is provided with two spring portions 338 which pretension the corresponding closure element 316 into the respective open position. Therefore, in a state without any outside influences, the handle 346 will be in the retraction position as shown in FIG. 8

FIG. 10 shows a partial sectional view along line X-X as shown in FIG. 9. In FIG. 10 there is shown that the container 302 according to the second embodiment is equipped, like the container 2 according to the first embodiment, with edge webs 318 at the bottom 304, with an edge web 322, a rib 324, a groove 324 as well as with a protrusion 327 at the lid 314, snap-in noses 330, first closure element mating pieces 334, second closure element mating pieces 336, hook elements 340 at the lid 314, first hook element mating pieces 342 as well as second hook element mating pieces 344.

The embodiments of the container according to the invention as shown in FIGS. 1 to 10 and as described above only represent two possible implementations.

The invention claimed is:

1. A foldable container, comprising:

a bottom, side walls, which are hinged in a pivotally movable manner at an edge of the bottom in such a way that they can be folded in, respectively, from an erected position, in which the corresponding side wall extends upwards transversely to the bottom, into a folded-in position, in which the corresponding side wall extends at least substantially in parallel to the bottom, a lid which is configured to be placed on the side walls in their erected position in order to close the foldable container in a closed position, and to be placed on the side walls in their folded-in position so that it can be stored or stowed away in a space-saving manner in a storage position in case of an empty transport, a closure element that can be moved relative to the lid and which is provided at least partially in a portion of an edge of the lid in order to lock the lid in the closed position, at least one first closure element mating piece which is provided at an edge of the side walls that faces away from the bottom in such a way at the side walls that, in the closed position of the lid, the at least one first closure element mating piece can interact in a form-fitting manner with the closure element, and at least one second closure element mating piece provided on a portion of the side walls that faces the bottom and/or on the bottom in such a way that, in the storage position of the lid, the at least one second closure element mating piece can interact in a form-fitting manner with the closure element in order to lock the lid in the storage position, wherein the closure element is coupled with the lid in such a way that it can be displaced relative to the lid from a locking position, in which the closure element is in engagement with the at least one first closure element mating piece in the closed position of the lid and/or in which the closure element is in engagement with the at least one second closure element mating piece in the storage position of the lid, into an open position, in which the closure element is not in engagement with the at least one first closure element mating piece in the closed position of the lid and/or in which the closure element is not in engagement with the at least one second closure element mating piece in the storage position of the lid, and the at least one closure element is pretensioned into the open position by means of a spring element which is implemented integrally with or separately from the closure element.

2. A foldable container, comprising:

a bottom, side walls, which are hinged in a pivotally movable manner at an edge of the bottom in such a way that they can be folded in, respectively, from an erected position, in which the corresponding side wall extends upwards transversely to the bottom, into a folded-in position, in which the corresponding side wall extends at least substantially in parallel to the bottom, a lid which is configured to be placed on the side walls in their erected position in order to close the foldable container in a closed position, and to be placed on the side walls in their folded-in position so that it can be stored or stowed away in a space-saving manner in a storage position in case of an empty transport, a closure element that can be moved relative to the lid and which is provided at least partially in a portion of an edge of the lid in order to lock the lid in the closed position, at least one first closure element mating piece which is provided at an edge of the side walls that faces away from the bottom in such a way at the side walls that, in the closed position of the lid, the at least one first closure element mating piece can interact in a form-fitting manner with the closure element, and at least one second closure element mating piece provided on a portion of the side walls that faces the bottom and/or on the bottom in such a way that, in the storage position of the lid, the at least one second closure element mating piece can interact in a form-fitting manner with the closure element in order to lock the lid in the storage position, wherein the closure element is coupled with the lid in such a way that it can be displaced relative to the lid from a locking position, in which the closure element is in engagement with the at least one first closure element mating piece in the closed position of the lid and/or in which the closure element is in engagement with the at least one second closure element mating piece in the storage position of the lid, into an open position, in which the closure element is not in engagement with the at least one first closure element mating piece in the closed position of the lid and/or in which the closure element is not in engagement with the at least one second closure element mating piece in the storage position of the lid, wherein:

a handle is connected with the lid in such a way that the handle can be moved relative to the lid from a holding position into a retraction position, the handle, in the holding position, protrudes farther away from the lid than in the retraction position, the handle is arranged at the at least one closure element in such a way that, in its holding position, the handle fixes or secures the at least one closure element in the locking position thereof, and the at least one closure element is pretensioned into the open position by means of a spring element which is implemented integrally with or separately from the closure element.

3. The foldable container according to claim 2, wherein the at least one closure element is implemented as a U-shaped bracket which comprises two free ends which, in the closed position of the lid and the locking position of the closure element, are each respectively in engagement with a corresponding first closure element mating piece and, in the storage position of the lid and the locking position of the closure element, are each respectively in engagement with a corresponding second closure element mating piece.

4. The foldable container according to claim 2, wherein the handle and the closure element are implemented such that a shifting of the handle from the retraction position into the holding position effects a shifting of the closure element from the open position into the locking position.

5. A foldable container, comprising:

a bottom, side walls, which are hinged in a pivotally movable manner at an edge of the bottom in such a way that they can be folded in, respectively, from an erected position, in which the corresponding side wall extends upwards transversely to the bottom, into a folded-in position, in which the corresponding side wall extends at least substantially in parallel to the bottom, a lid which is configured to be placed on the side walls in their erected position in order to close the foldable container in a closed position, and to be placed on the side walls in their folded-in position so that it can be stored or stowed away in a space-saving manner in a storage position in case of an empty transport, a closure element that can be moved relative to the lid and which is provided at least partially in a portion of an edge of the lid in order to lock the lid in the closed position, at least one first closure element mating piece which is provided at an edge of the side walls that faces away from the bottom in such a way at the side walls that, in the closed position of the lid, the at least one first closure element mating piece can interact in a form-fitting manner with the closure element, and at least one second closure element mating piece provided on a portion of the side walls that faces the bottom and/or on the bottom in such a way that, in the storage position of the lid, the at least one second closure element mating piece can interact in a form-fitting manner with the closure element in order to lock the lid in the storage position, wherein, at said portion of the edge of the lid that is provided with the closure element a groove is provided into which at least one portion of said edge of the corresponding side wall that faces away from the bottom, projects in the closed position of the lid, wherein, the foldable container further comprises:

at least one hook element which is provided in a portion of the edge of the lid which lies opposite to the portion of the edge of the lid that is provided with the closure element, at least one first hook element mating piece which is provided in such a way at the side walls that, in the closed position of the lid, the at least one first hook element mating piece can interact in a form-fitting manner with the hook element, and at least one second hook element mating piece which is provided on the portion of the side walls that faces the bottom and/or on the bottom in such a way that, in the storage position of the lid, the at least one second hook element mating piece can interact in a form-fitting manner with the hook element in order to lock the lid in the storage position, and wherein:

the at least one first closure element mating part is implemented as a recess in an inner surface of the side walls, the at least one first hook element mating piece is implemented as a recess in an outer surface of the side walls, an edge web is provided, respectively, at portions of the edge of the bottom at which one of the two side walls, respectively, is hinged in a pivotally movable manner, the at least one second closure element mating piece is implemented as a recess in an inner surface of one of the edge webs, and the at least one second hook element mating piece is implemented as a recess in an outer surface of one of the edge webs.

6. The foldable container according to claim 5, wherein at the edge of the lid at least one groove is provided into which at least one portion of said edge of the side walls that faces away from the bottom projects in the closed position of the lid, so that a folding-in of at least one of the side walls can be prevented in a form-fitting manner by means of the at least one groove.

7. The foldable container according to claim 5, wherein the side walls are implemented such that two mutually opposed first side walls have to be in the folded-in position so that two mutually opposed second side walls can be folded in, and for both first side walls a groove is provided respectively at the edge of the lid, into which groove at least one portion of said edge of the corresponding first side wall that faces away from the bottom projects in the closed position of the lid.

8. The foldable container according to claim 7, wherein the lid is implemented such that said portion of the edge of the lid that is provided with the closure element rests on one of the second side walls in the closed position and in the storage position of the lid.

9. The foldable container according to claim 7, wherein:

each of the second side walls comprises at least one first closure element mating piece and at least one first hook element mating piece, and each edge web comprises at least one second closure element mating piece and at least one second hook element mating piece.

10. A foldable container according to claim 9, wherein:

the at least one first closure element mating piece and the at least one first hook element mating piece of a respective second side wall are implemented together by means of a joint passage opening, and/or the at least one second closure element mating piece and the at least one second hook element mating piece of a respective edge web are implemented together by means of a joint passage opening.

11. The foldable container according to claim 5, wherein the closure element is coupled with the lid in such a way that it can be pivotally moved relative to the lid from a locking position, in which the closure element is in engagement with the at least one first closure element mating piece in the closed position of the lid and/or in which the closure element is in engagement with the at least one second closure element mating piece in the storage position of the lid, into an open position, in which the closure element is not in engagement with the at least one first closure element mating piece in the closed position of the lid and/or in which the closure element is not in engagement with the at least one second closure element mating piece in the storage position of the lid.

12. A foldable container, comprising:

a bottom, side walls, which are hinged in a pivotally movable manner at an edge of the bottom in such a way that they can be folded in, respectively, from an erected position, in which the corresponding side wall extends upwards transversely to the bottom, into a folded-in position, in which the corresponding side wall extends at least substantially in parallel to the bottom, a lid which is configured to be placed on the side walls in their erected position in order to close the foldable container in a closed position, and to be placed on the side walls in their folded-in position so that it can be stored or stowed away in a space-saving manner in a storage position in case of an empty transport, a closure element that can be moved relative to the lid and which is provided at least partially in a portion of an edge of the lid in order to lock the lid in the closed position, at least one first closure element mating piece which is provided at an edge of the side walls that faces away from the bottom in such a way at the side walls that, in the closed position of the lid, the at least one first closure element mating piece can interact in a form-fitting manner with the closure element, and at least one second closure element mating piece provided on a portion of the side walls that faces the bottom and/or on the bottom in such a way that, in the storage position of the lid, the at least one second closure element mating piece can interact in a form-fitting manner with the closure element in order to lock the lid in the storage position, wherein, the side walls are implemented such that two mutually opposed first side walls have to be in the folded-in position so that two mutually opposed second side walls can be folded in, for both first side walls a groove is provided respectively at the edge of the lid, into which groove at least one portion of said edge of the corresponding first side wall that faces away from the bottom projects in the closed position of the lid, and the foldable container further comprises:

at least one hook element which is provided in a portion of the edge of the lid which lies opposite to the portion of the edge of the lid that is provided with the closure element, at least one first hook element mating piece which is provided at said edge of the side walls that faces away from the bottom in such a way at the side walls that, in the closed position of the lid, the at least one first hook element mating piece can interact in a form-fitting manner with the hook element, and at least one second hook element mating piece which is provided on the portion of the side walls that faces the bottom and/or on the bottom in such a way that, in the storage position of the lid, the at least one second hook element mating piece can interact in a form-fitting manner with the hook element in order to lock the lid in the storage position, wherein, the at least one first closure element mating part is implemented as a recess in an inner surface of the second side walls, the at least one first hook element mating piece is implemented as a recess in an outer surface of the second side walls, an edge web is provided, respectively, at portions of the edge of the bottom at which one of the two side walls, respectively, is hinged in a pivotally movable manner, the at least one second closure element mating piece is implemented as a recess in an inner surface of one of the edge webs, and the at least one second hook element mating piece is implemented as a recess in an outer surface of one of the edge webs.

* * * * *